US011761619B1

(12) United States Patent
Xu et al.

(10) Patent No.: US 11,761,619 B1
(45) Date of Patent: Sep. 19, 2023

(54) ADAPTER AND LED LAMP USING THE ADAPTER

(71) Applicant: SHENZHEN SNC OPTO ELECTRONIC CO., LTD, Shenzhen (CN)

(72) Inventors: Jianyong Xu, Shenzhen (CN); Anle Zhao, Shenzhen (CN); Zhiyuan Li, Shenzhen (CN)

(73) Assignee: SHENZHEN SNC OPTO ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 18/098,716

(22) Filed: Jan. 19, 2023

(30) Foreign Application Priority Data

Oct. 23, 2022 (CN) ..... 202222795514.3

(51) Int. Cl.

| | |
|---|---|
| ***F21V 23/06*** | (2006.01) |
| ***F21V 23/00*** | (2015.01) |
| ***F21V 17/10*** | (2006.01) |
| ***F21V 17/12*** | (2006.01) |
| ***F21V 17/06*** | (2006.01) |
| *F21Y 115/10* | (2016.01) |

(52) U.S. Cl.
CPC ..... *F21V 23/06* (2013.01); *F21V 17/06* (2013.01); *F21V 17/108* (2013.01); *F21V 17/12* (2013.01); *F21V 23/006* (2013.01); *F21Y 2115/10* (2016.08)

(58) Field of Classification Search
CPC ..... F21V 23/06; F21V 17/06; F21V 17/108; F21V 17/12; F21V 23/006; F21Y 2115/10
See application file for complete search history.

(56) References Cited

U.S. PATENT DOCUMENTS

| | | | | |
|---|---|---|---|---|
| 2004/0066142 | A1* | 4/2004 | Stimac | F21K 9/238 315/56 |
| 2012/0238146 | A1* | 9/2012 | Liao | H01R 31/06 439/660 |
| 2014/0286020 | A1* | 9/2014 | Tsai | F21K 9/232 362/363 |
| 2016/0209017 | A1* | 7/2016 | Feller | F21S 8/00 |
| 2021/0388952 | A1* | 12/2021 | Wan | F21K 9/66 |

* cited by examiner

*Primary Examiner* — Evan P Dzierzynski

(57) ABSTRACT

The present disclosure provides an adapter and an LED lamp using the adapter, the adapter including a first body with an upper portion and a lower portion opposite to the upper portion, a first electrical connection member fixedly installed on the upper portion and electrically connected with the LED lamp, a second electrical connection member with one end electrically connecting with the first electrical connection member, the other end thereof connecting with an external electronic control member, and fixedly installed on the lower portion, the upper portion including a first wall with a first recess for arranging the first electrical connection member therein, the lower portion including a second wall with a second recess for arranging the second electrical connection member therein, the external electronic control member including a third electrical connection member electrically connected with the second electrical connection member, and at least one conductive post thereof.

18 Claims, 13 Drawing Sheets

ADAPTER AND LED LAMP USING THE ADAPTER

BACKGROUND

1. Technical Field

The present disclosure generally relates to the field of lighting technologies, and especially relates to an adapter and an LED lamp using the adapter.

2. Description of Related Art

LED lamps have advantages of energy saving, a long life and being easy control, etc, which are in line with a global advocacy of energy conservation and emission reduction, and have been widely used in various lighting fields. In order to obtain better energy saving or a control effect, some conventional LED lamps are equipped with sensors, wireless controllers or other electronic control components that are configured to control the LED lamps. However, the conventional LED lamp can be only connected with the electronic control component with a single specification thereof, and dimensions and specifications of most lamp bodies or electronic control components produced by different countries or manufacturers are different, which makes a plurality of LED lamps unable to be simultaneously applied for other electronic control components with other specifications, resulting in greatly reducing a flexible usage of the LED lamp in other countries or regions, which is not conducive to a promotion and application of such LED lamp in the world. In this way, only different specifications of bodies of the LED lamps are needed to be produced to match different specifications of the electronic control components from different countries or manufacturers, which will lead to a significant increase in production costs.

SUMMARY

The technical problems to be solved: in view of the shortcomings of the related art, the present disclosure relates to an adapter and an LED lamp using the adapter which can connect with different external electronic control members by the adapter.

an adapter according to a first aspect of an embodiment of the present disclosure includes: a first body including an upper portion detachably connected with an LED lamp, and a lower portion opposite to the upper portion and configured to detachably connect with an external electronic control member; a first electrical connection member fixedly installed on the upper portion and configured to electrically connect with the LED lamp; a second electrical connection member fixedly installed on the lower portion, one end of the second electrical connection member electrically connected with the first electrical connection member, and the other end of the second electrical connection member electrically connected with the external electronic control member; and wherein the upper portion includes a first wall with a first recess being formed thereof, the first electrical connection member arranged in the first recess; and wherein the lower portion includes a second wall with a second recess being formed thereof, the second electrical connection member arranged in the second recess; the external electronic control member including a third electrical connection member electrically connected with the second electrical connection member, and the third electrical connection member including at least one conductive post thereof.

An LED lamp according to a second aspect of an embodiment of the present disclosure includes: a housing, an external electronic control member, and an adapter with one end being detachably connected with the housing and the other end being detachably connected with the external electronic control member; the adapter including a first body, a first electrical connection member and a second electrical connection member, the body including an upper portion detachably connected with the housing, and a lower portion opposite to the upper portion and configured to detachably connect with the external electronic control member; the first electrical connection member fixedly installed on the upper portion and configured to electrically connect with the housing, the second electrical connection member fixedly installed on the lower portion, one end of the second electrical connection member electrically connected with the first electrical connection member, and the other end of the second electrical connection member electrically connected with the external electronic control member; and wherein the upper portion includes a first wall with a first recess being formed thereof, the first electrical connection member arranged in the first recess; and wherein the lower portion includes a second wall with a second recess being formed thereof, the second electrical connection member arranged in the second recess; the external electronic control member including a third electrical connection member electrically connected with the second electrical connection member, and the third electrical connection member including at least one conductive post thereof.

The present disclosure provides the advantages as below: the present disclosure provides the adapter applied for the LED lamp, by setting the adapter of the present disclosure, the housing of the LED lamp can be connected with external electronic control members of different specifications, that is, in addition to the housing of the LED lamp itself can be connected with the external electronic control member with a specification, the housing can also be connected with another external electronic control member with another specification through the adapter, so that the LED lamp can be applied for the external electronic control members with different specifications in different countries. The external electronic control member can be an external electronic control component, such as a sensor or a wireless controller etc., externally connected to the housing, so as to control lighting, a color or a brightness of the LED lamp.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

The element labels according to the embodiment of the present disclosure shown as below:

100 LED lamp, 10 housing, 11 first case, 12 second body, 121 first protrusion, h outer surface, 122 guiding recess, 123 installing hole, 124 conductive splint, 1241 connecting portion, 1242 clamping arm, 1243 first plate, 1244 second plate, 1245 third plate, 1246 guiding plate, 125 limiting recess, 126 first clamping recess, 13 fourth electrical connection member, 14 second installation member, 20 external electronic control member, 21 second case, 22 third electrical connection member, 23 first installation member, 24 second screw thread, 30 adapter, 31 first body, 311 upper portion, 3111 first wall, g inner surface, 3112 first recess, 3113 guiding post, 3114 terminal, 3115 limiting post, 3116 first hook, 3117 vertical wall, 3118 horizontal wall, 312 lower portion, 3121 second wall, 3122 second recess, 3123 first screw thread, 32 first electrical connection member, in side surface, 33 second electrical connection member, 331 inserting portion, 332 first circuit board, 333 second circuit board, f fastener, e buckle groove, a conductive post.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described exemplary embodiment of the present disclosure, all other embodiments obtained by one of ordinary skill in the related art on the premise of no creative work are within the protection scope of the present disclosure.

It should also be understood that the terms used in the specification of the present disclosure are only for the purpose of describing specific embodiments without being intended to limit the present disclosure. As used in the description of the present disclosure and the appended claims, terms of "one", "one" and "the" in a singular form are intended to include a plural form unless the context clearly indicates otherwise.

It should also be further understood that the term "and/or" used in the description of the present disclosure and the appended claims refers to any combination of one or more of associated listed items and all possible combinations, and includes these combinations.

Figure 1:
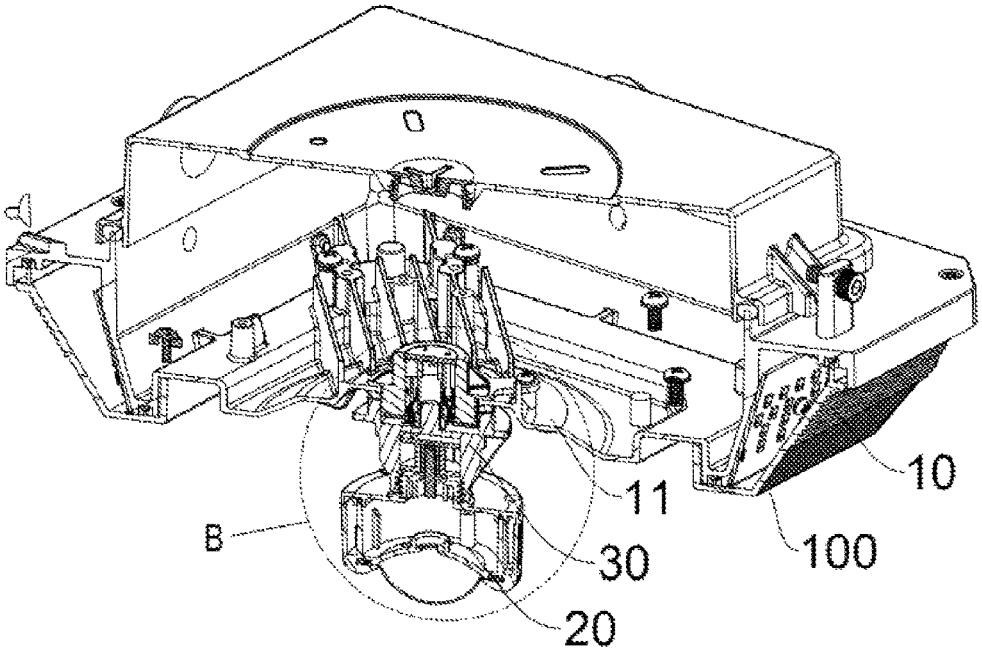
FIG. 1 is a cross sectional schematic view of an LED lamp in accordance with an embodiment of the present disclosure.
Figure 2:
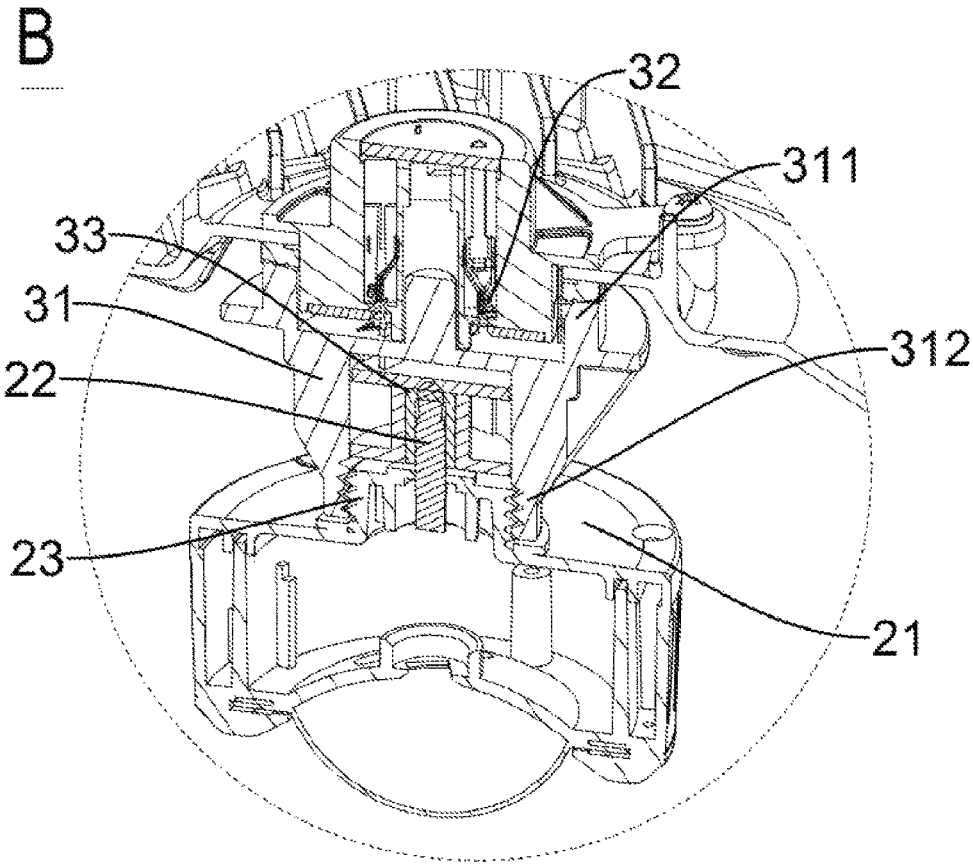
FIG. 2 is a partial enlarged view of a circle B of the LED lamp of FIG. 1.
Figure 3:
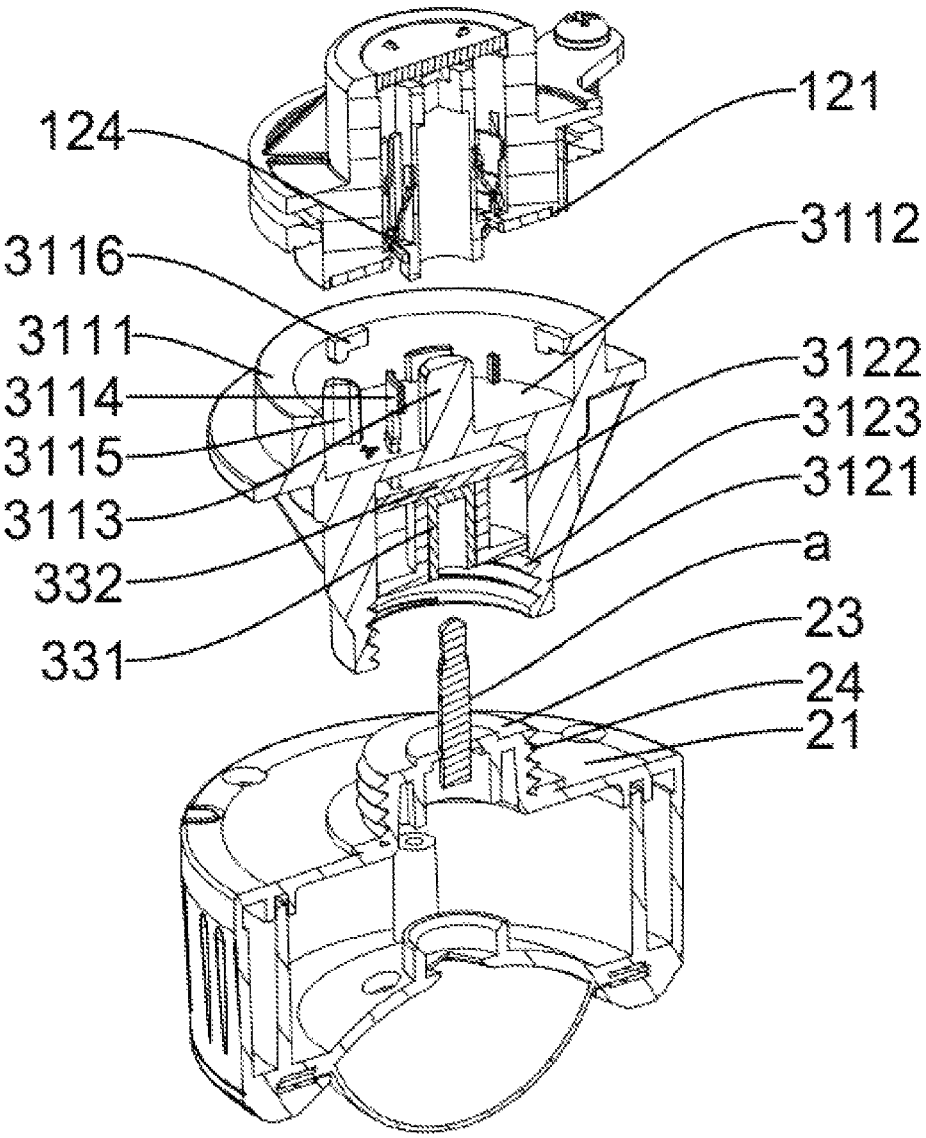
FIG. 3 is a cross sectional view of an adapter according to an embodiment of the present disclosure, which is connected with other components of the LED lamp of FIG. 1.
Figure 4:
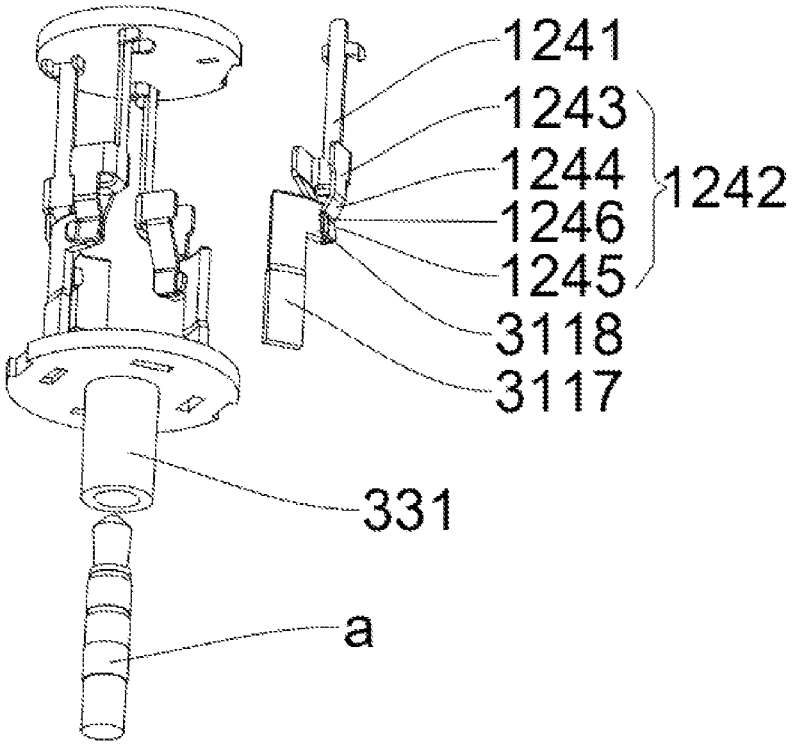
FIG. 4 is an exploded, schematic view of the adapter electrically connected with components of the LED lamp of FIG. 3.
Figure 5:
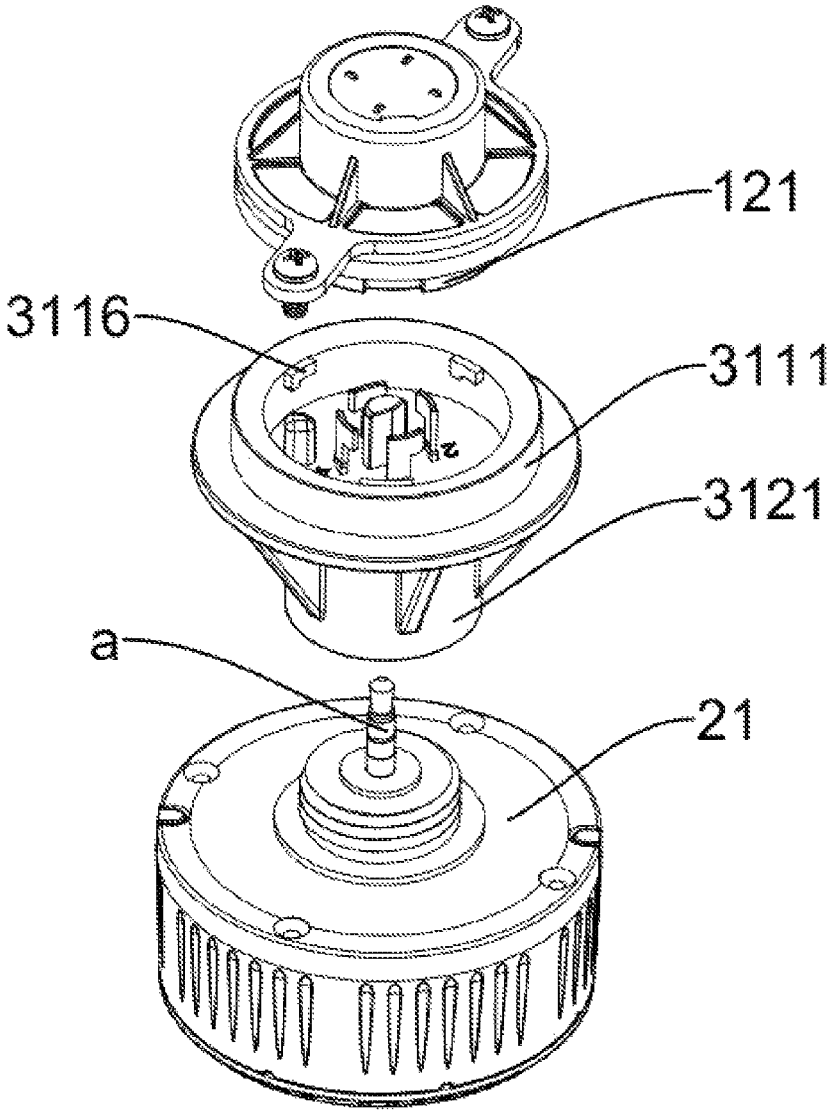
FIG. 5 is a schematic view of the adapter connected with other components of the LED lamp of FIG. 3.
Figure 6:
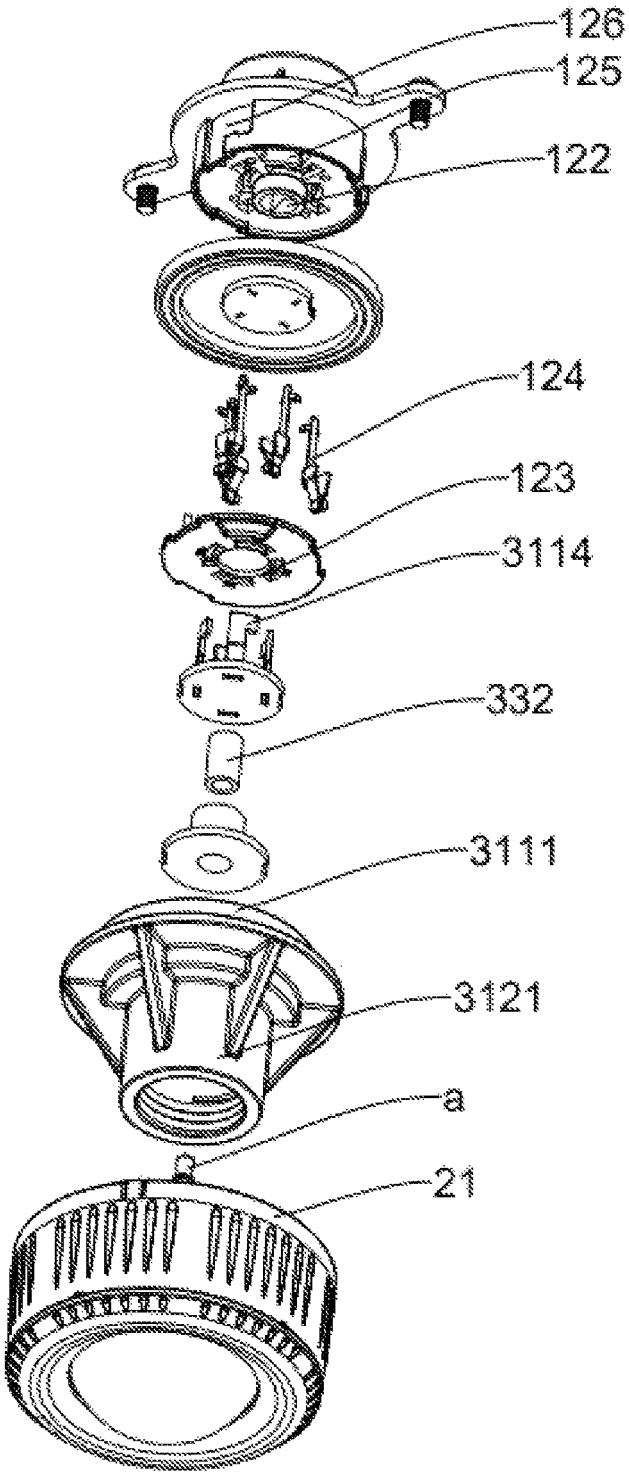
FIG. 6 is a partial exploded, schematic view of the LED lamp of FIG. 1.
Figure 7:
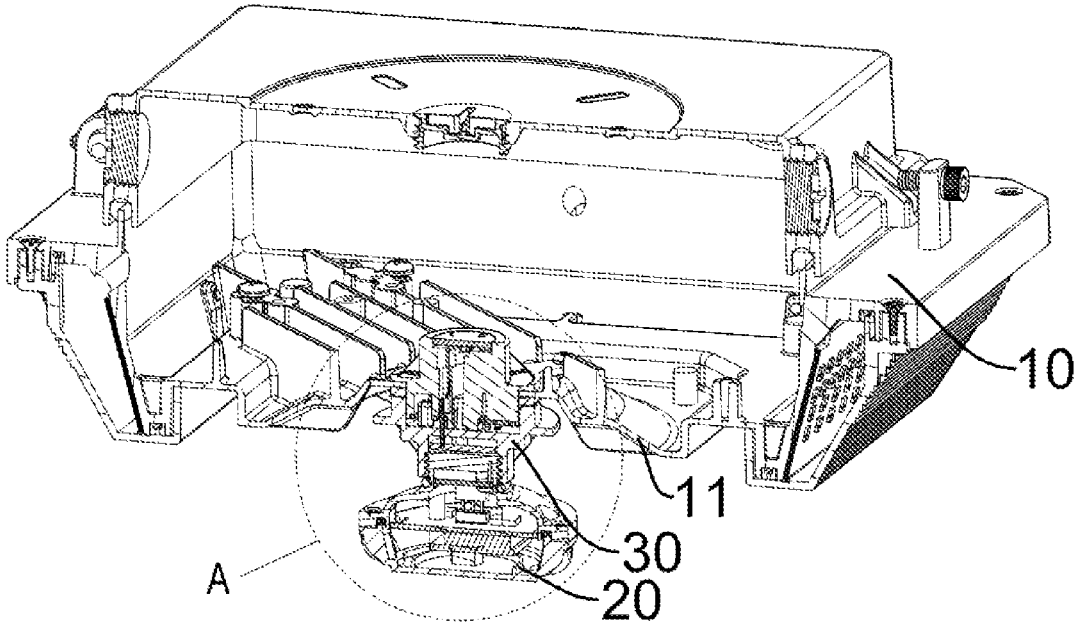
FIG. 7 is a cross sectional schematic view of an LED lamp in accordance with another embodiment of the present disclosure.
Figure 8:
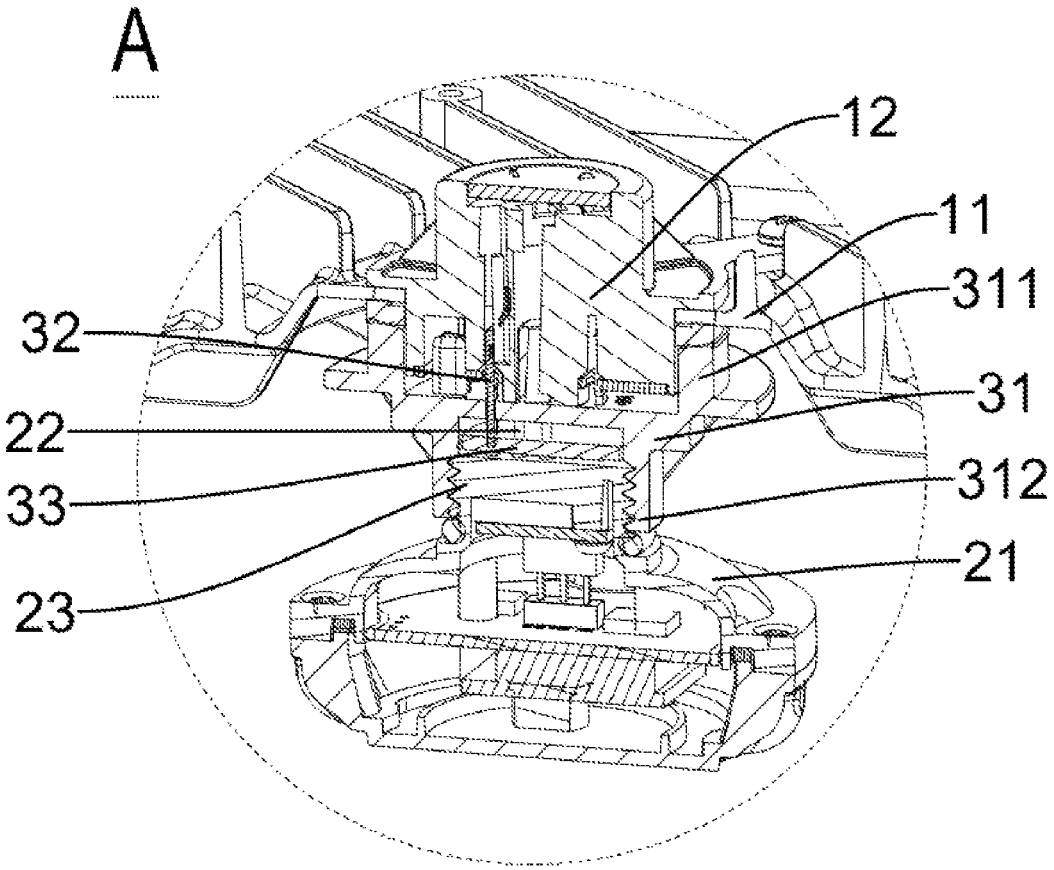
FIG. 8 is a partial enlarged view of a circle A of the LED lamp of FIG. 7.
Figure 9:
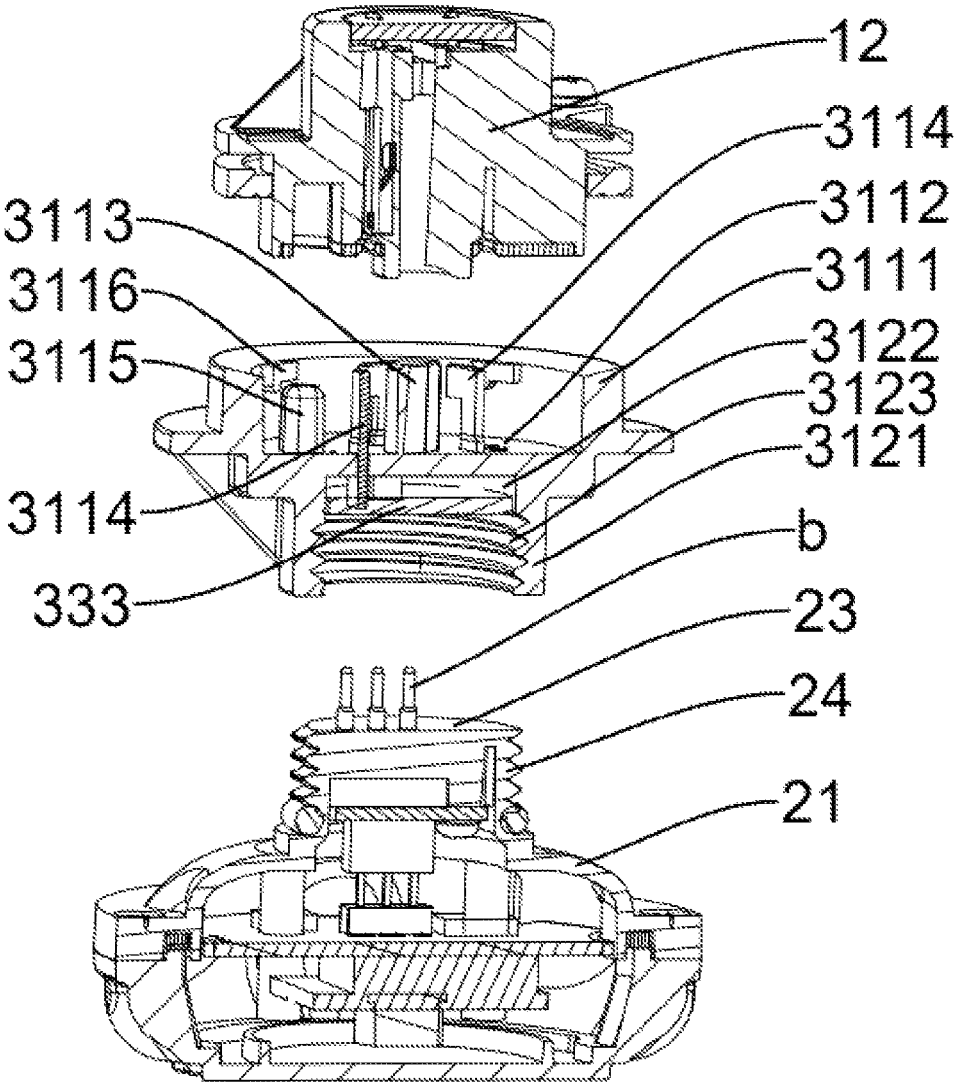
FIG. 9 is a cross sectional view of an adapter according to another embodiment of the present disclosure, which is connected with other components of the LED lamp of FIG. 7.
Figure 10:
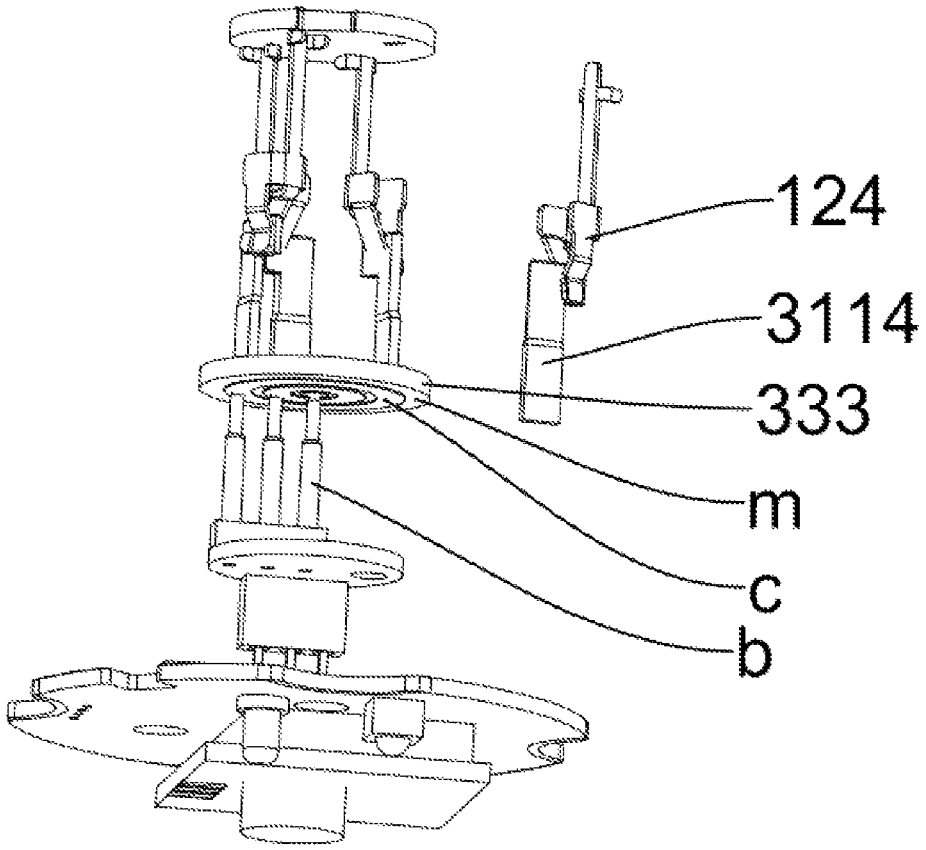
FIG. 10 is an exploded, schematic view of the adapter electrically connected with components of the LED lamp of FIG. 9.
Figure 11:
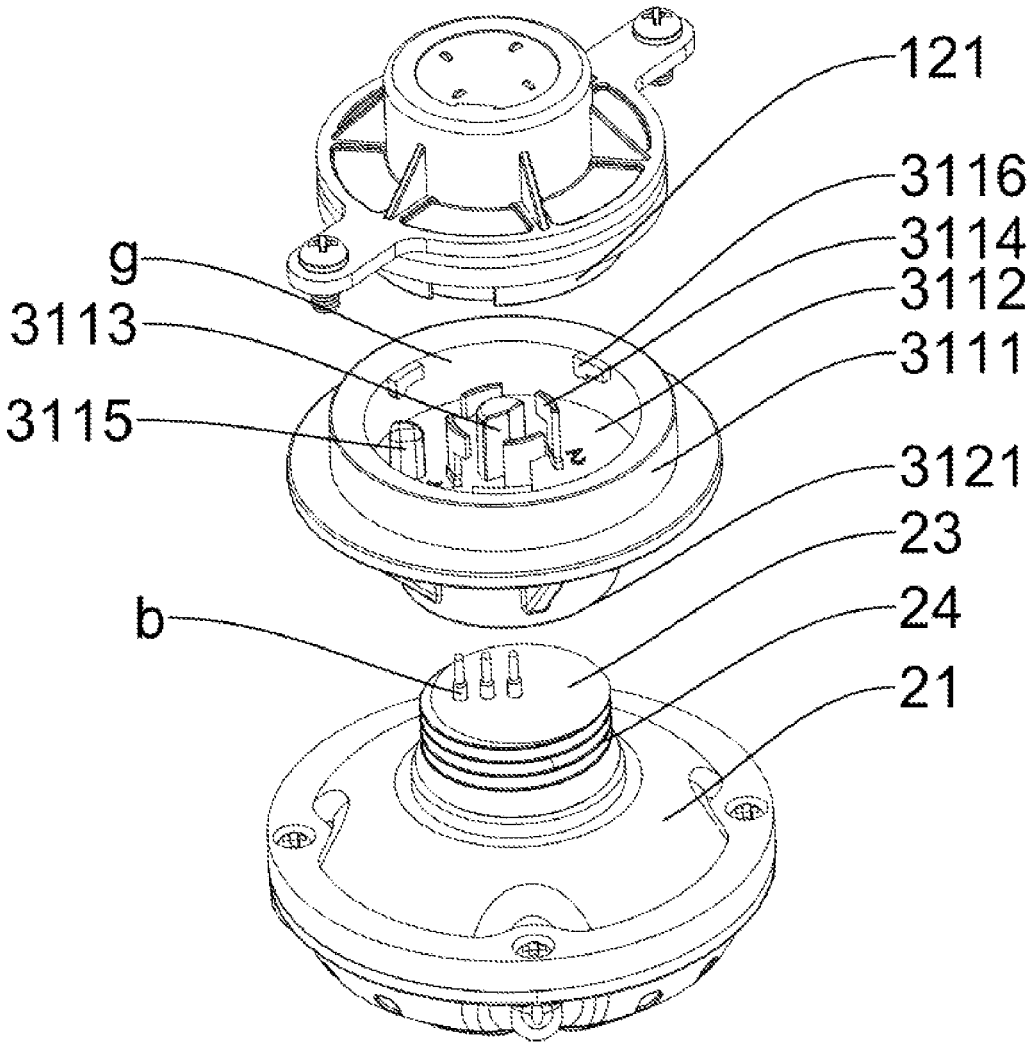
FIG. 11 is a schematic view of the adapter connected with other components of the LED lamp of FIG. 9.
Figure 12:
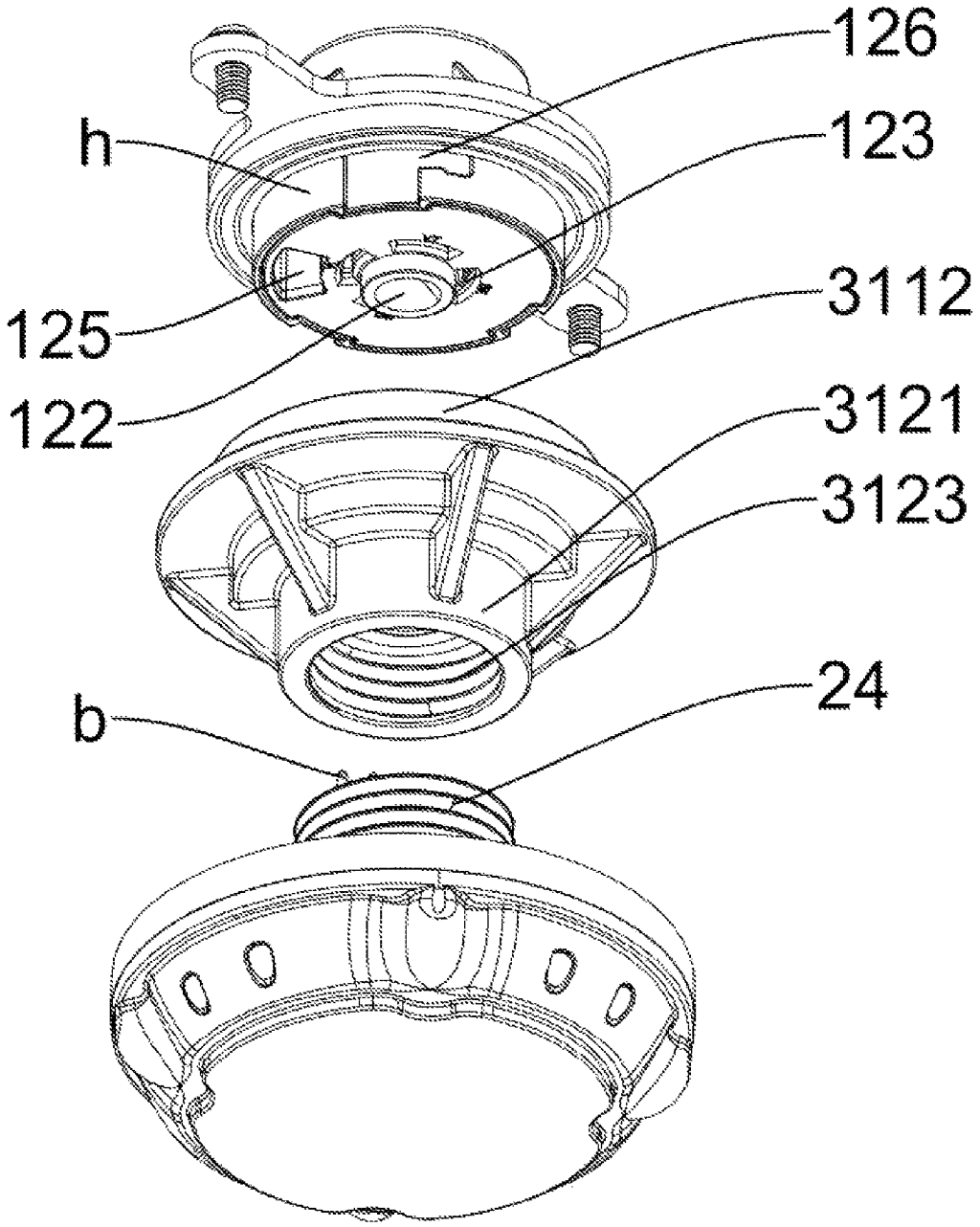
FIG. 12 is similar to FIG. 11, but shown from another view.
Figure 13:
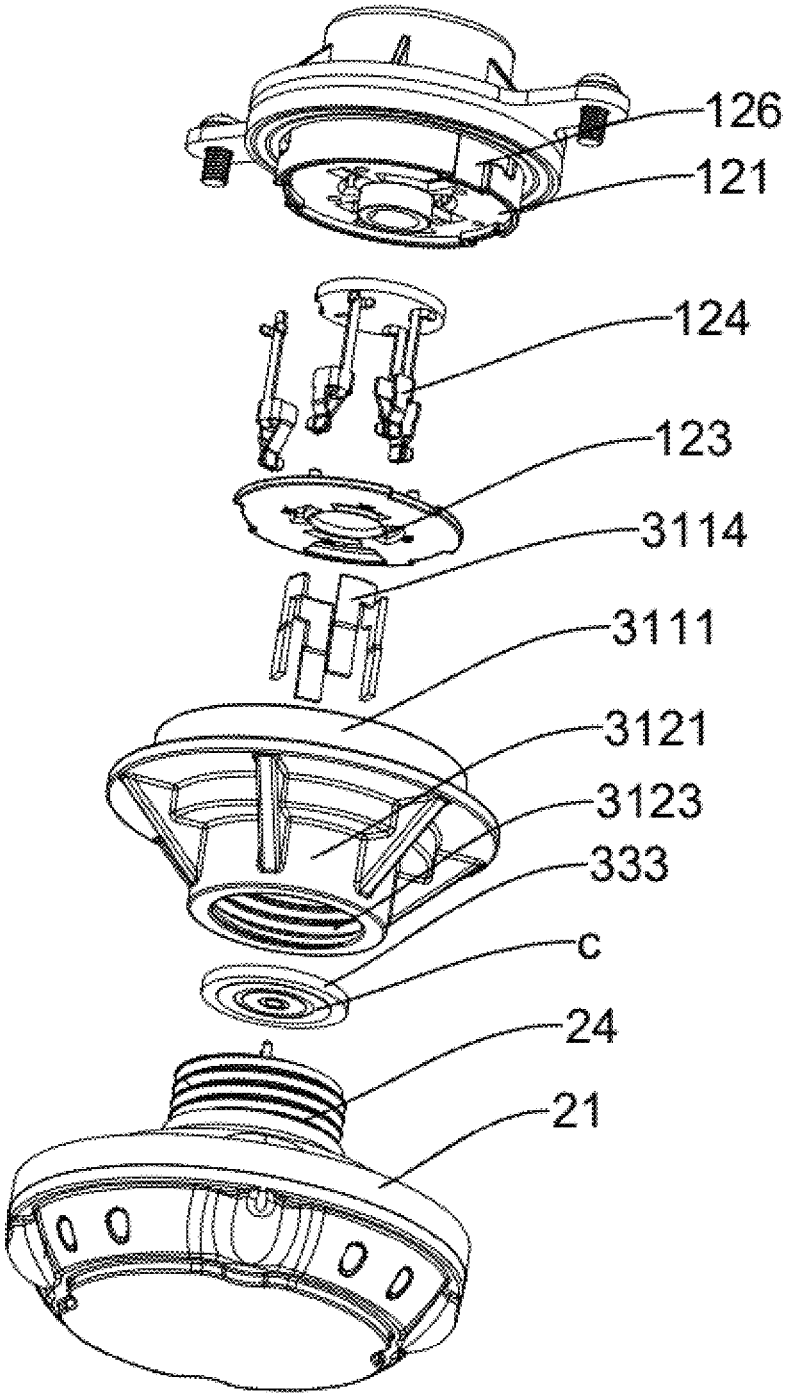
FIG. 13 is a partial exploded, schematic view of the LED lamp of FIG. 7.

Referring to FIGS. 1-3, an adapter 30 in accordance with an embodiment of the present disclosure is applied for an LED lamp 100 and includes a first body 31, a first electrical connection member 32 and a second electrical connection member 33. The first body 31 includes an upper portion 311 arranged close to the LED lamp 100 and detachably connected with the LED lamp 100, and a lower portion 312 opposite to the upper portion 311 and arranged close to an external electronic control member 20 and detachably connected with the external electronic control member 20.

The first electrical connection member 32 is fixedly installed on the upper portion 311 and configured to electrically connect with the LED lamp 100. The second electrical connection member 33 is fixedly installed on the lower portion 312, one end of the second electrical connection member 33 is electrically connected with the first electrical connection member 32, and the other end of the second electrical connection member 33 is electrically connected with the external electronic control member 20.

In an embodiment of the present disclosure, the upper portion 311 includes a first wall 3111 with a first recess 3112 being formed thereof, the first electrical connection member 32 arranged in the first recess 3112. The lower portion 312 includes a second wall 3121 with a second recess 3122 being formed thereof, the second electrical connection member 33 arranged in the second recess 3122; the external electronic control member 20 including a third electrical connection member 22 electrically connected with the second electrical connection member 33, and the third electrical connection member 33 including at least one conductive post a thereof. The LED lamp 100 of the present disclosure can be connected with the external electronic control member 20 with a specification, and another external electronic control member 20 with another specification can be also connected with the LED lamp 100 through the adapter 30, so as to obtain a purpose of wider applicability of the LED lamp 100. In the present disclosure, the first wall 3111 and the second wall 3121 can be annular walls, such as annular walls or annular walls with openings.

In an optical embodiment of the present disclosure, the first electrical connection member 32 includes a plurality of terminals 3114 arranged in the first recess 3112 and uniformly arranged around an axis of the first recess 3112. The terminal 3114 is an L-shaped configuration. The LED lamp 100 includes a plurality of conductive splints 124 adapted to the plurality of terminals 3114, and the plurality of terminals 3114 is rotated to be inserted into the plurality of conductive splints 124 so as to electrically connect the adapter 30 and the LED lamp 100.

A guiding post 3113 is arranged at the center of the first recess 3112, and a limiting post 3115 arranged between the plurality of terminals 3114 and the first wall 3111; a guiding recess 122 arranged on the LED lamp 100 and corresponding to the guiding post 3113, a limiting recess 125 arranged on the LED lamp 100 and corresponding to the limiting post 3115, the guiding post 3113 inserted into the guiding recess 122, and the limiting post 3115 inserted into the limiting recess 125. A cross section of the guiding post 3113 is a D-shaped configuration or a fan-shaped configuration. The limiting post 3115 can prevent an excessive force from causing the guiding post 3113 with a relatively small size, the guiding recess 122, the terminal 3114, and the conductive splint 124 to be twisted, when the adapter 30 is rotated and docked with the LED lamp 100.

Referring to FIG. 1 to FIG. 6, in an optical embodiment of the present disclosure, the third electrical connection member 22 of the external electronic control member 20 is a single conductive post a, the second electrical connection member 33 of the adapter 30 including an inserting portion 331, and a first circuit board 332 arranged between the inserting portion 331 and the first electrical connection member 332, one end of the first circuit board 332 electrically connected to the first electrical connection member 32, and the other end of the first circuit board 332 electrically connected to the inserting portion 331, so as to electrically connect the external electronic control member 20 with the adapter 30. In the embodiment, the housing 10 itself can be connected with the external electronic control member 20, and the external electronic control member 20 with a single-pin type can be connected with the LED lamp 100 through the adapter 30. In some embodiments, the conductive post is a single earphone plug.

Referring to FIG. 7 to FIG. 13, in another optical embodiment of the present disclosure, the third electrical connection member 22 includes a plurality of elastic conductive posts b arranged side by side, the second electrical connection member 33 including a second circuit board 333 with a side surface in towards the first electrical connection member 32 being electrically connected to the first electrical connection member 32, the second circuit board 333 including a plurality of annular conductive rings c arranged on the side surface in of the second circuit board 333 towards the third electrical connection member 22, and the plurality of elastic conductive posts b correspondingly abutted against the plurality of annular conductive rings c to electrically connect the second electrical connection member 33 with the third electrical connection member 22. The third electrical connection member 22 can be three elastic conductive posts b arranged side by side, by the adapter 30 of the embodiment, the LED lamp 100 can be externally connected with a three-piece external electronic control member 20. In some embodiments, each of the plurality of elastic conductive posts is an elastic thimble, and one of the plurality of elastic thimbles is coaxial with the first wall 3111.

An LED lamp 100 according to an embodiment of the present disclosure is provided and includes a housing 10, an external electronic control member 20 and an adapter 30. One end of the adapter 30 is detachably connected with the housing 10 and the other end of the adapter 30 is detachably connected with the external electronic control member 20. The adapter 30 includes a first body 31, a first electrical connection member 32 and a second electrical connection member 33. The first body 31 includes an upper portion 311 detachably connect with the housing 10, and a lower portion 312 opposite to the upper portion 311 and configured to detachably connect with the external electronic control member 20. The first electrical connection member 32 is configured to electrically connect the adapter 30 with the housing 10, and the second electrical connection member 33 is configured to electrically connect the adapter 30 with the external electronic control member 20. The LED lamp 100 of the present disclosure can be connected with the external electronic control member 20 with a specification, and another external electronic control member 20 with another specification can be also connected with the LED lamp 100 through the adapter 30, so as to obtain a purpose of wider applicability of the LED lamp 100.

The housing 10 includes a first case 11 including a second body 12 formed thereof, the second body 12 including a fourth electrical connection member 13 electrically connected with the first electrical connection member 32, and a second installation member 14 detachably connected with the upper portion 31.

The external electronic control member 20 includes a second case 21 including the third electrical connection member 22 and a first installation member 23, the third electrical connection member 22 electrically connected to the second electrical connection member 33, and the first installation member 23 detachably connected with the lower portion 312.

The upper portion 311 of the adapter 30 includes a first wall 3111 with a first recess 3112 being formed thereof, the first electrical connection member 32 arranged in the first recess 3112. The lower portion 312 includes a second wall 3121 with a second recess 3122 being formed thereof, and the second electrical connection member 33 is arranged in the second recess 3122.

The second body 12 includes a first protrusion 121 inserted into the first recess 3112, a guiding recess 122 arranged in a middle of the first protrusion 121, and a guiding post 3113 arranged in a middle of the first recess 3112 for inserting into the guiding recess 122. A plurality of installing holes 123 is arranged around the peripheral of the first protrusion 121 to correspondingly receive a plurality of conductive splints 124 in the plurality of installing holes 123, a plurality of terminals 3114 arranged in the peripheral of the first recess 3112, the terminals 3114 rotated to insert into the plurality of conductive splints 124 so as to electrically connect the adapter 30 with the LED lamp 100. A limiting post 3115 is arranged between the plurality of terminals 3114 and the first wall 3111, and a limiting hole 125 is arranged at the first protrusion 121 and corresponding to the limiting post 3115, the limiting post 3115 inserted into the limiting hole 125. The plurality of terminals 3114 is L-shape. A cross section of the guiding post 3114 is a D-shaped configuration or a fan-shaped configuration. The limiting post 3115 can prevent an excessive force from causing the guiding post 3113 with a relatively small size, the guiding recess 122, the terminal 3114, and the conductive splint 124 to be twisted, when the adapter 30 is rotated and docked with the LED lamp 100.

In an embodiment of the present disclosure, each of the plurality of terminals 3114 is an L-shape configuration and includes a vertical wall 3117 and a horizontal wall 3118 connected with the vertical wall 3117. The conductive splint 35 includes a connecting portion 1241, and a pair of clamping arms 1242 opposite to each other and integrally connected with the connecting portion 1241, each of the pair of clamping arms 1242 including a first plate 1243, a second plate 1244, and a third plate 1245 arranged in parallel to the first plate 1243, one end of the second plate 1244 connected with the first plate 1243 and the other end of the second plate 1244 connected with the third plate 1245; the third plates 1245 of the pair of clamping arms 1242 fitted with each other, the first plates 1243 of the pair of clamping arms 1242 arranged at intervals. One end of the vertical wall 3117 of the terminal 3114 is connected to an electronic control part of the housing 10, and the other end of the vertical wall 3117 is connected to the horizontal wall 3118 that is inserted between the two third plates 1245, so as to electrically connect the electronic control part of the housing 10 with the adapter 30. In an embodiment of the present disclosure, each of the pair of clamping arms 1242 further includes a guiding plate 1246, one end of the guiding plate 1246 connected with the third plate 1245, and the other end of the guiding plate 1246 extending outwardly. Two guiding plates 1244 of the pair of clamping arms 1242 form an outward expanding opening therebetween. When the adapter 30 is installed, the horizontal wall 3118 of the terminal 3114 first extends into the opening, and then the adapter 30 rotates to rotate the terminal 3114 to further insert the horizontal wall 3118 into the third plate 1245, thereby good electrical contact can be ensured.

A plurality of first clamping recesses 126 is arranged on an outer peripheral surface h of the first protrusion 121, and arranged around an axis of the first protrusion 121, a plurality of first hooks 3116 arranged on an inner peripheral surface g of the first wall 3111 and arranged around an axis of first wall 3111, the plurality of first hooks 3116 correspondingly matched with the plurality of first clamping recesses 126, and the plurality of first hooks 3116 correspondingly clamped into the plurality of first clamping recesses 126 to detachably connect the upper portion 311 with the first protrusion 121, thereby the adapter 30 detachably connected with the housing 10. The second wall 3121 includes a first screw thread 3123 formed on an inner peripheral surface thereof, and the first installation member 23 of the external electronic control member 20 includes a second screw thread 24 matched with the first screw thread 3123, the adapter 30 detachably connected with the external electronic control member 20 through the first screw thread 3123 engaging with the second screw thread 24.

Figure 14:
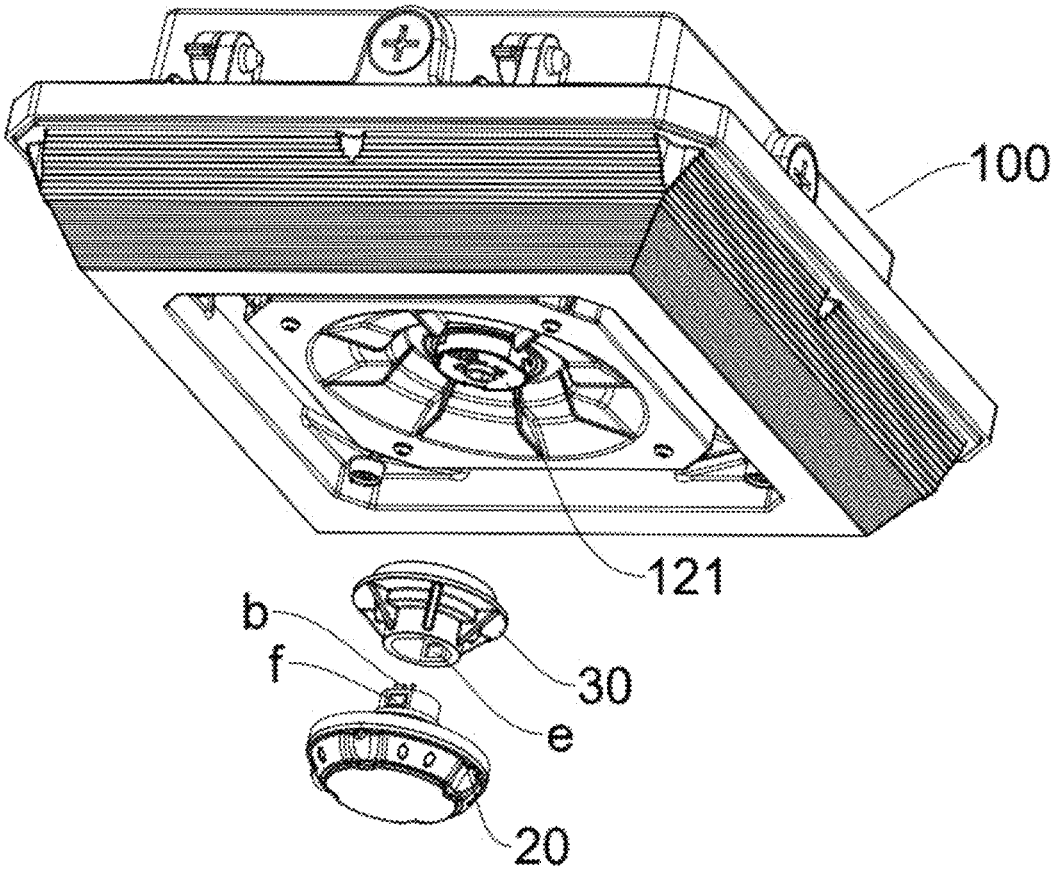
FIG. 14 is an exploded, schematic view of the LED lamp of FIG. 1.
Figure 15:
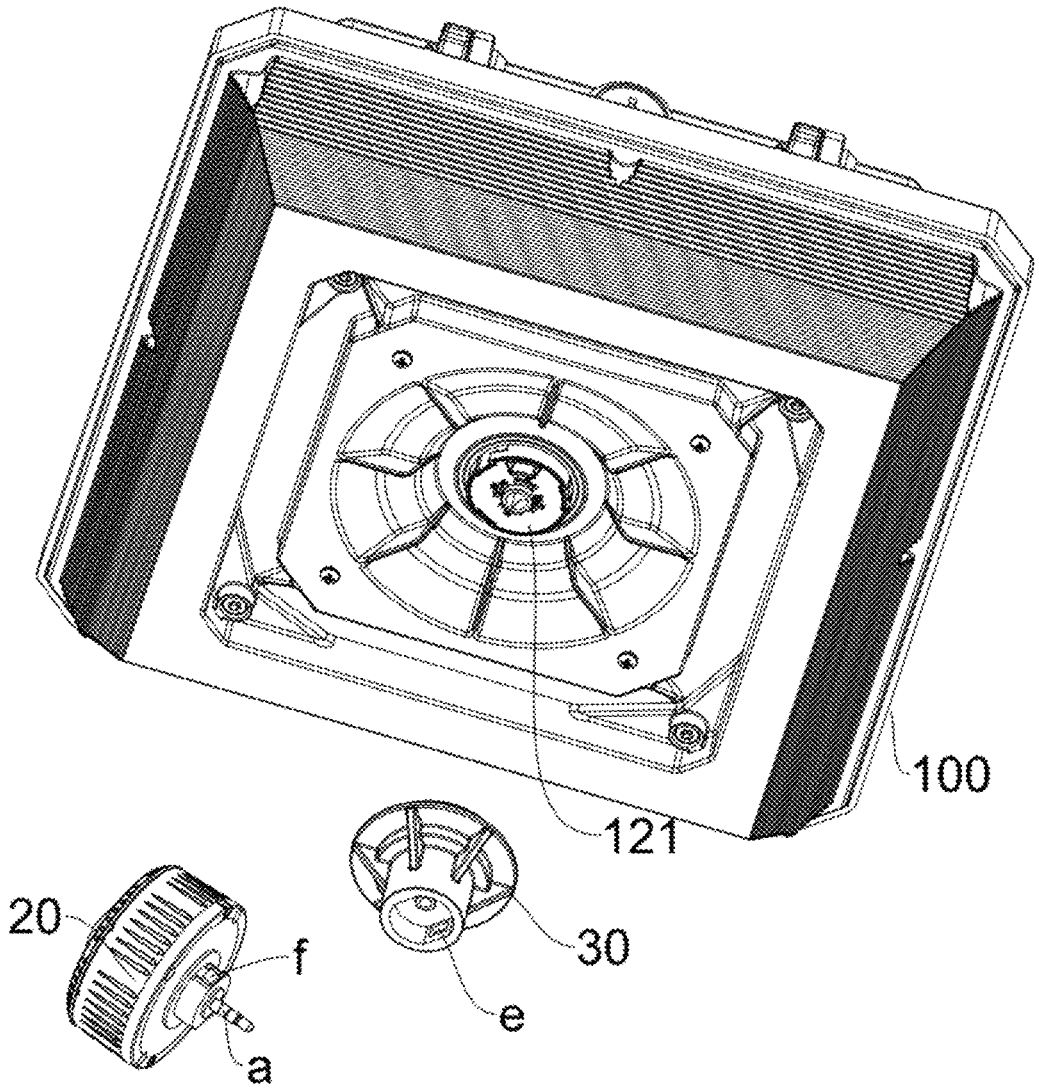
FIG. 15 is an exploded, schematic view of the LED lamp of FIG. 7.

Referring to FIG. 14 and FIG. 15, in some embodiments of the present disclosure, the LED lamp 100 and the adapter 30 can also be detachably connected with each other by a fastener f and a buckle groove e, and the external electronic control member 20 and the adapter 30 can also be detachably connected with each other by the fastener f and the buckle groove e.

Referring to FIG. 1 to FIG. 6, in an optical embodiment of the present disclosure, the first electrical connection member 32 of the external electronic control member 20 is a single conductive post a, the second electrical connection member 33 of the adapter 30 including the inserting portion 331 and the first circuit board 332 arranged between the inserting portion 331 and the first electrical connection member 32. One end of the first circuit board 332 is electrically connected to the first electrical connection member 32, and the other end of the first circuit board 332 is electrically connected to the inserting portion 331, so as to electrically connect the external electronic control member 20 with the adapter 30. In the embodiment, the housing 10 itself can be connected with the external electronic control member 20, and the external electronic control member 20 with a single-pin type can be connected with the LED lamp 100 through the adapter 30.

Referring to FIG. 7 to FIG. 13, in another optical embodiment of the present disclosure, the third electrical connection member 22 includes a plurality of elastic conductive posts b arranged side by side, the second electrical connection member 33 including a second circuit board 333 with a side surface in towards the first electrical connection member 32 being electrically connected to the first electrical connection member 32, the second circuit board 333 including a plurality of annular conductive rings c arranged on the side surface in of the second circuit board 333 towards the third electrical connection member 22, and the plurality of elastic conductive posts b correspondingly abutted against the plurality of annular conductive rings c to electrically connect the second electrical connection member 33 with the third electrical connection member 22. The third electrical connection member 22 can be three elastic conductive posts b arranged side by side, by the adapter 30 of the embodiment, the LED lamp 100 can be externally connected with a three-piece external electronic control member 20.

The external electronic control member 20 can be selected from one of a sensor and a wireless controller.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. An adapter comprising:

a first body comprising an upper portion detachably connected with an LED lamp, and a lower portion opposite to the upper portion and configured to detachably connect with an external electronic control member;

a first electrical connection member fixedly installed on the upper portion and configured to electrically connect with the LED lamp;

a second electrical connection member fixedly installed on the lower portion, one end of the second electrical connection member electrically connected with the first electrical connection member, and the other end of the second electrical connection member electrically connected with the external electronic control member; and wherein the upper portion comprises a first wall with a first recess being formed thereof, the first electrical connection member arranged in the first recess; and wherein the lower portion comprises a second wall with a second recess being formed thereof, the second electrical connection member arranged in the second recess; the external electronic control member comprising a third electrical connection member electrically connected with the second electrical connection member, and the third electrical connection member comprising at least one conductive post thereof.

2. The adapter as claimed in claim 1, wherein the first electrical connection member comprises a plurality of terminals arranged in the first recess and uniformly arranged around an axis of the first recess.

3. The adapter as claimed in claim 2, wherein a guiding post is arranged at the center of the first recess, and a limiting post is arranged between the plurality of terminals and the first wall; a guiding recess arranged on the LED lamp and corresponding to the guiding post, a limiting recess arranged on the LED lamp and corresponding to the limiting post, the guiding post inserted into the guiding recess, and the limiting post inserted into the limiting recess.

4. The adapter as claimed in claim 1, wherein the third electrical connection member is a single conductive post, the second electrical connection member comprising an inserting portion and a first circuit board, one end of the first circuit board electrically connected to the first electrical connection member, and the other end of the first circuit board electrically connected to the inserting portion, the conductive post inserted into the inserting portion, to electrically connect the external electronic control member with the single conductive post.

5. The adapter as claimed in claim 4, wherein the conductive post is a single earphone plug.

6. The adapter as claimed in claim 1, wherein the third electrical connection member comprises a plurality of elastic conductive posts arranged side by side, the second electrical connection member comprising a second circuit board with a side surface towards the first electrical connection member being electrically connected to the first electrical connection member, the second circuit board comprising a plurality of annular conductive rings arranged on a side surface of the second circuit board towards the third electrical connection member, and the plurality of elastic conductive posts correspondingly abutted against the plurality of annular conductive rings to electrically connect the second circuit board with the plurality of elastic conductive posts.

7. The adapter as claimed in claim 6, wherein each of the plurality of elastic conductive posts is an elastic thimble, and one of the plurality of elastic thimbles is coaxial with the first wall.

8. The adapter as claimed in claim 1, wherein the first wall comprises a plurality of first hooks arranged at an inner peripheral surface thereof and around an axis of the first wall, a plurality of first clamping recesses arranged on the LED lamp and corresponding to the plurality of first hooks, and the plurality of first hooks correspondingly clamped into the plurality of first clamping recesses to detachably connect the upper portion with the LED lamp.

9. The adapter as claimed in claim 1, wherein the second wall comprises a first screw thread formed on an inner peripheral surface thereof, and the external electronic control member comprises a second screw thread matched with the first screw thread, and the lower portion detachably connected with the external electronic control member through the first screw thread engaging with the second screw thread.

10. An LED lamp comprising:

a housing;

an external electronic control member;

an adapter with one end being detachably connected with the housing and the other end being detachably connected with the external electronic control member; the adapter comprising a first body, a first electrical connection member and a second electrical connection member, the body comprising an upper portion detachably connected with the housing, and a lower portion opposite to the upper portion and configured to detachably connect with the external electronic control member; the first electrical connection member fixedly installed on the upper portion and configured to electrically connect with the housing, the second electrical connection member fixedly installed on the lower portion, one end of the second electrical connection member electrically connected with the first electrical connection member, and the other end of the second electrical connection member electrically connected with the external electronic control member; and wherein the upper portion comprises a first wall with a first recess being formed thereof, the first electrical connection member arranged in the first recess; and wherein the lower portion comprises a second wall with a second recess being formed thereof, the second electrical connection member arranged in the second recess;

the external electronic control member comprising a third electrical connection member electrically connected with the second electrical connection member, and the third electrical connection member comprising at least one conductive post thereof.

11. The LED lamp as claimed in claim 10, wherein the housing comprises a first case comprising a second body formed thereof, the second body comprising a fourth electrical connection member electrically connected with the first electrical connection member, and a second installation member detachably connected with the upper portion.

12. The LED lamp as claimed in claim 10, wherein the external electronic control member comprises a second case comprising the third electrical connection member and a first installation member, the third electrical connection member electrically connected to the second electrical connection member, and the first installation member detachably connected with the lower portion.

13. The LED lamp as claimed in claim 11, wherein the second body comprises a first protrusion inserted into the first recess, a guiding recess arranged in a middle of the first protrusion, and a guiding post arranged in a middle of the first recess for inserting into the guiding recess; a plurality of installing holes arranged around the peripheral of the guiding recess to correspondingly receive a plurality of conductive splints in the plurality of installing holes, a plurality of terminals arranged in the peripheral of the guiding post and rotated to insert into the plurality of conductive splints; a limiting post arranged between the plurality of terminals and the first wall, a limiting hole arranged at the first protrusion and corresponding to the limiting post, and the limiting post inserted into the limiting hole.

14. The LED lamp as claimed in claim 13, wherein each of the plurality of terminals is an L-shape configuration and comprises a vertical wall and a horizontal wall connected with the vertical wall, the conductive splint comprising a connecting portion, and a pair of clamping arms opposite to each other and integrally connected with the connecting portion, each of the pair of clamping arms comprising a first plate, a second plate, and a third plate arranged in parallel to the first plate, both ends of the second plate connected with the first plate and the third plate, respectively, the third plates of the pair of clamping arms fitted with each other, the first plates of the pair of clamping arms arranged at intervals, and the horizontal wall inserted between the third plates of the pair of clamping arms.

15. The LED lamp as claimed in claim 13, wherein a plurality of first clamping recesses is arranged on an outer peripheral surface of the first protrusion, and arranged around an axis of the first protrusion, a plurality of first hooks arranged on an inner peripheral surface of the first wall and correspondingly matching with the plurality of first clamping recesses, and the plurality of first hooks correspondingly clamped into the plurality of first clamping recesses to detachably connect the upper portion with the first protrusion.

16. The LED lamp as claimed in claim 13, wherein the third electrical connection member is a single conductive post, the second electrical connection member comprising an inserting portion and a first circuit board, one end of the first circuit board electrically connected to the first electrical connection member, and the other end of the first electrical connection member connected to the inserting portion, the conductive post inserted into the inserting portion, to electrically connect the external electronic control member with the single conductive post.

17. The LED lamp as claimed in claim 13, wherein the third electrical connection member comprises three elastic conductive posts arranged side by side, the second electrical connection member comprising a second circuit board with a side surface towards the first electrical connection member being electrically connected to the first electrical connection member, the second circuit board comprising three annular conductive rings arranged on a side surface of the second circuit board towards the third electrical connection member, and the three elastic conductive posts correspondingly abutted against the three annular conductive rings to electrically connect the second electrical connection member with the third electrical connection member.

18. The LED lamp as claimed in claim 11, wherein the external electronic control member is selected from one of a sensor and a wireless controller.

* * * * *